United States Patent [19]

Lerner

[11] 4,333,411

[45] Jun. 8, 1982

[54] BOBBIN THREAD LEVEL DETECTION AND DISPLAY ARRANGEMENT FOR A SEWING MACHINE

[75] Inventor: David A. Lerner, Flushing, N.Y.

[73] Assignee: The Singer Company, Stamford, Conn.

[21] Appl. No.: 283,403

[22] Filed: Jul. 15, 1981

[51] Int. Cl.[3] ..... D05B 45/00; D05B 59/00

[52] U.S. Cl. ..... 112/278

[58] Field of Search ..... 112/278, 273; 139/273 A; 242/37 R; 250/571

[56] References Cited

U.S. PATENT DOCUMENTS

| | | | |
|---|---|---|---|
| 2,420,275 | 5/1947 | Winberg | 112/278 |
| 3,129,680 | 4/1964 | Doerner . | |
| 3,599,586 | 8/1971 | Newman . | |
| 3,991,692 | 11/1979 | Papajewski et al. . | |
| 4,163,158 | 7/1979 | Coughenour et al. . | |
| 4,178,866 | 12/1979 | Adams . | |
| 4,180,007 | 12/1979 | Peterson et al. . | |
| 4,188,901 | 2/1980 | Beckerman . | |
| 4,188,902 | 2/1980 | Kahan . | |
| 4,193,363 | 3/1980 | Beckerman et al. . | |
| 4,212,257 | 7/1980 | Herron et al. | 112/278 |
| 4,214,542 | 7/1980 | Odermann . | |
| 4,216,733 | 8/1980 | Kornatowski . | |
| 4,280,423 | 7/1981 | Goncharko | 112/158 E |

*Primary Examiner*—Peter P. Nerbun

*Attorney, Agent, or Firm*—David L. Davis; Robert E. Smith; Edward L. Bell

[57] ABSTRACT

A bobbin thread level detection and display arrangement for a sewing machine includes an array of light emitting diodes which are activated to convey to the sewing machine operator an indication of the quantity of thread left of the bobbin. To control the light emitting diodes, an arrangement utilizing a light source and a phototransistor is arranged proximate the bobbin. The circuitry for controlling the activation of the light emitting diodes also provides for a "fading in" of the individual light emitting diodes to provide a display in the nature of a bar graph.

3 Claims, 3 Drawing Figures

BOBBIN THREAD LEVEL DETECTION AND DISPLAY ARRANGEMENT FOR A SEWING MACHINE

BACKGROUND OF THE INVENTION

This invention relates to sewing machines and, more particularly, to an arrangement for informing the sewing machine operator as to the amount of thread remaining on the bobbin of the sewing machine.

There are a number of known arrangements in the prior art for signalling a sewing machine operator as to the impending depletion of bobbin thread. Such an arrangement is desirable in order to warn an operator of impending bobbin exhaustion which might interfere with the appearance of a long seam. A number of these arrangements utilize a light source and a light detector arranged so that when there is thread on the bobbin the optical path from the light source to the light detector is blocked, this path being opened when the amount of thread remaining on the bobbin is depleted below some threshold value. Upon the occurrence of this latter condition, appropriate circuitry activates an alarm, or indicator, that warns the operator amount of thread remaining on the bobbin is below the predetermined threshold. Such an arrangement is disclosed, for example, in U.S. Pat. No. 4,188,901. Another arrangement of this general type is disclosed in U.S. Pat. No. 4,212,257 wherein an operator is advised both of impending depletion of the bobbin and also when the bobbin is full, the latter being for the purpose of preventing overwinding of the bobbin.

The prior low bobbin thread detection systems sense when the threaded bobbin diameter is below some threshold level. However, the bobbin thread is typically depleted from the bobbin in a non-uniform and unpredictable manner so that the threaded diameter of the bobbin is not uniform along the bobbin axis. Thus, there will be occassions wherein the optical path between the light source and the light detector is blocked by thread along one portion of the bobbin hub whereas another portion of the bobbin hub may have the thread completely depleted therefrom. Accordingly, the abovementioned arrangements may not provide an entirely accurate indication of the amount of thread remaining on the bobbin. It is therefore an object of the present invention to provide a bobbin thread level detection and display system which is insensitive to variations in the threaded bobbin diameter along the axis of the bobbin.

The aforedescribed arrangements inform an operator when the amount of thread on the bobbin is above or below some critical value but do not provide any other information to the operator. It would be desirable to be able to inform the operator as to the level of thread on the bobbin even before the operator is advised as to the impending depletion of the thread. It is therefore another object of the this invention to provide an arrangement whereby the operator is continuously informed of the thread carrying condition of the bobbin over a range of such conditions.

SUMMARY OF THE INVENTION

The foregoing and additional objects are attained in accordance with the principles of this invention by providing a bobbin thread level detection and display system in a sewing machine which includes means for sensing the thread carrying condition of the bobbin, the sensing means including a light source and a light detector. The inventive arrangement comprises a display device including a plurality of light emitting elements positioned in a regular array and energizing means responsive to the amount of light impinging on the light detector for controlling the energization of the plurality of light emitting elements to produce a visible light pattern in the display device that is related to the thread carrying condition of the bobbin.

BRIEF DESCRIPTION OF THE DRAWINGS

The foregoing will be more readily apparent upon reading the following description in conjunction with the drawings in which like reference characters in different figures thereof denote like elements and wherein.

DETAILED DESCRIPTION

Figure 1:
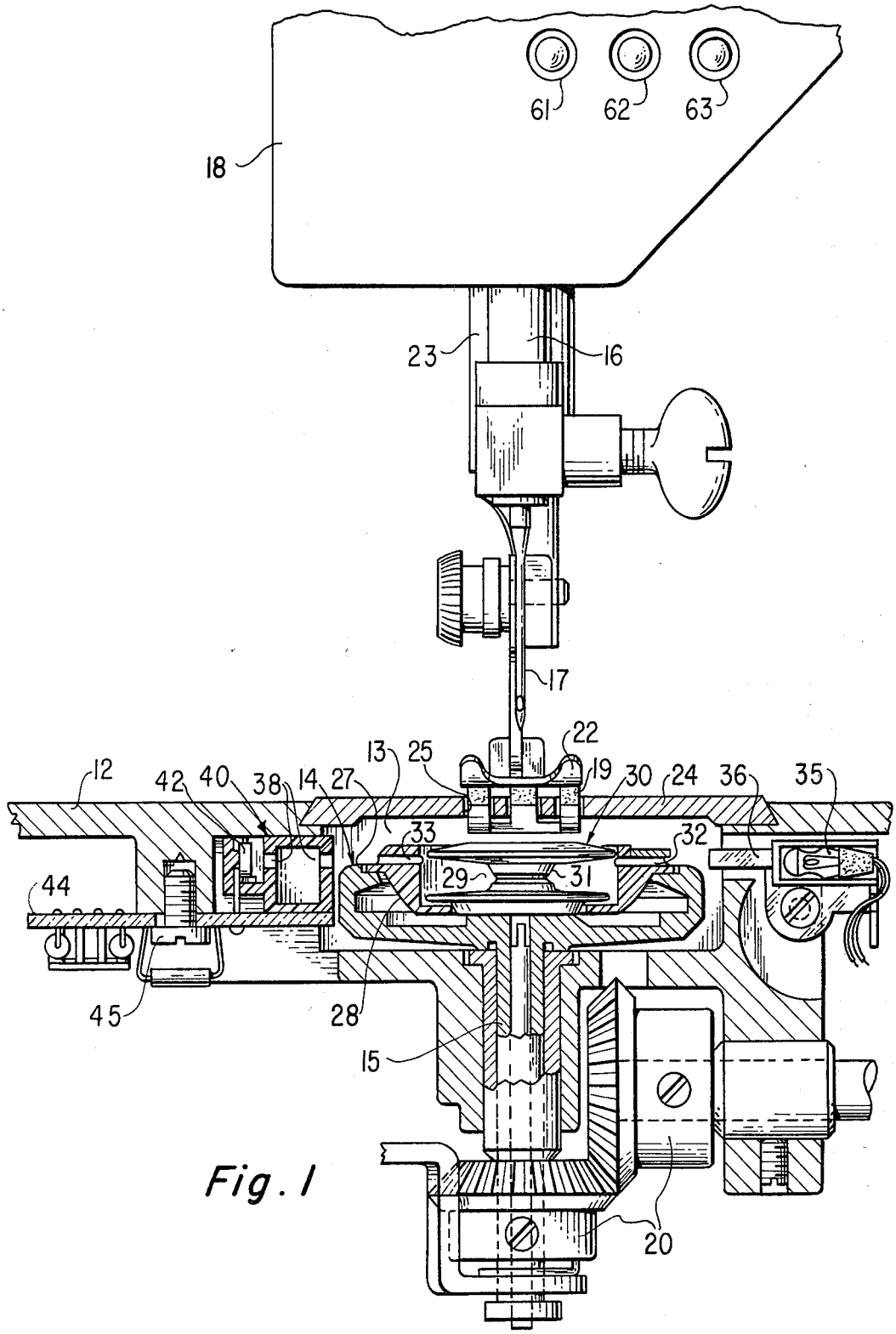
FIG. 1 is an enlarged view of a portion of the head end and loop taker of a sewing machine shown partially in section in order to show more detail thereof and in which this invention may be incorporated.

Referring now to the drawings, FIG. 1 shows a portion of a sewing machine having a bed 12 and a sewing head 18 overhanging the bed 12. The bed 12 is formed with a cavity 13 in which a loop taker 14 is rotatably carried on one extremity of a shaft 15 oriented so as to have a vertical axis. The shaft 15 is driven by bevel gears 20 which are driven in the usual manner by the main sewing machine drive motor (not shown). The loop taker 14 rotates in timed synchronization to the reciprocation of the needle bar 16, the needle 17 carried by the needle bar 16 being driven in endwise reciprocation through a work material supported on the bed 12 for cooperation with the loop taker 14 carried therein in the formation of stitches. A feed dog 19 is visible which is a portion of a feeding system (not shown) for feeding work material under the sewing needle 17 in order to generate a pattern of stitches. The work material is pressed against the feed dog 19 by a presser foot 22 supported on the end of a presser bar 23 which is urged downwardly in a manner well known in the sewing machine art. A throat plate 24 supports the work material and is fashioned with an orifice (not shown) through which the sewing needle 17 may project. The throat plate 24 is further formed with slots 25 through which the feed dog 19 may extend.

Figure 2:
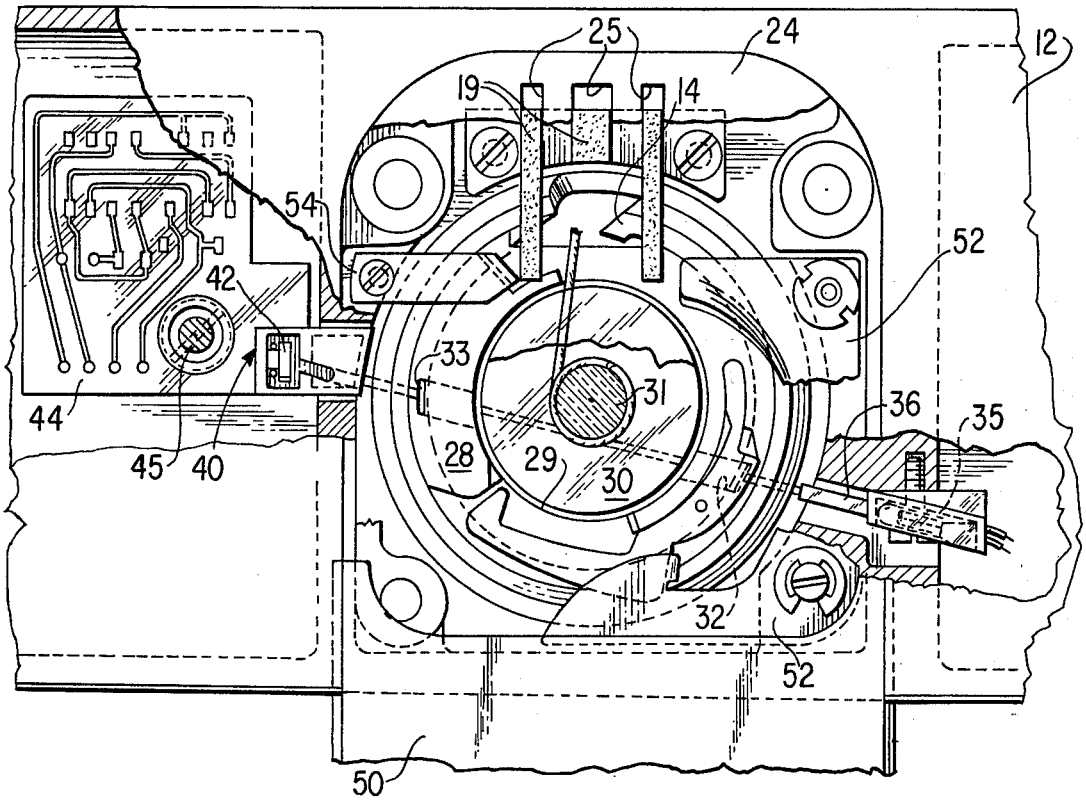
FIG. 2 is a plan view of the loop taker and bobbin area of the sewing machine indicating the placement of a light detector and box therefor and a light source.

The loop taker 14 supports on a race 27 thereof a bobbin case 28. The bobbin case 28 is restrained from rotary motion with the loop taker 14 by a position plate 52 (FIG. 2). The bobbin case 28 is fashioned with a cavity 29 within which is supported a bobbin 30 for the carrying of lower thread for a lockstitch. A further explanation of the loop taker 14, the bobbin case 28 and bobbin 30 arrangement and how thread may be wound thereupon may be had by reference to U.S. Pat. No. 3,693,566. The teachings of this patent have been modified somewhat by extending the bobbin case 28 above the level of the loop taker 14 in order that bores 32, 33 might extend therethrough roughly tangent the hub 31 of the bobbin 30 (FIG. 2). The purpose of the bores 32, 33 is to allow the passage of light from a light source 35 as focused by a lens 36. The light rays extending from the bore 33 pass through orifices 38 in a mask box 40, which box 40 supports a light detector 42 on an inner wall thereof aligned with the orifices 38 and the bores 32, 33. A printed circuit board 44 is affixed to the bed 12 by means of a screw 45 and the mask box 40 is supported on the printed circuit board 44 with the light detector 42 having electrical connections thereto.

Referring now to FIG. 2, there is shown a plan view of the left side of the bed 12 showing the cavity 13 therein with the throat plate 24 removed and with a bed slide 50 thereof slid back to expose the loop taker 14, the bobbin case 28 and the bobbin 30. There is also visible a portion of the position plate 52 and a position finger 54 which serve to retain the bobbin case 28 in a stationary position against rotation with the loop taker 14 while permitting thread to be cast thereabout.

In accordance with the principles of this invention, a display device is provided, illustratively on the head 18, for displaying the thread carrying condition of the bobbin 30. This display device illustratively includes three light emitting elements 61, 62 and 63. As will be described in full detail hereinafter, this display functions as a bar graph display and is of an analog nature to inform continuously the sewing machine operator as to how much thread remains on the bobbin 30. Illustratively, when the bobbin is full, all of the light emitting elements 61, 62 and 63 will be off. Then, as the bobbin 30 begins to be depleted, the light emitting element 61 will first turn on, then the light emitting element 62 will turn on while the light emitting element 61 remains on, and finally when the bobbin 30 is nearly empty, all three light emitting elements 61, 62 and 63 will be turned on. A feature of the present invention, as will be described hereinafter, is that the light emitting elements 61, 62 and 63 will gradually brighten, rather than abruptly turn on, with decreasing bobbin thread levels.

Figure 3:
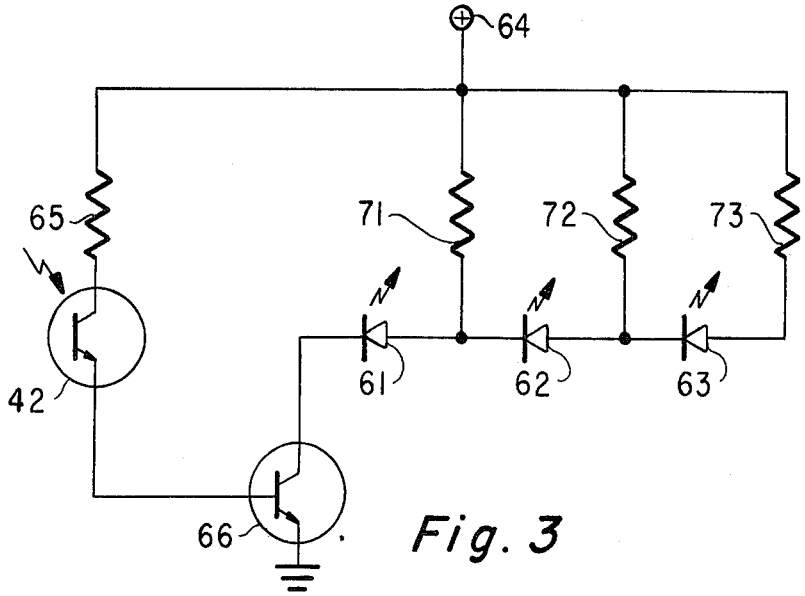
FIG. 3 is a schematic diagram of circuitry constructed in accordance with the principles of this invention for detecting and displaying the thread carrying condition of the bobbin of the sewing machine shown in FIGS. 1 and 2.

FIG. 3 shown an illustrative circuit constructed in accordance with the principles of this invention for controlling the aforedescribed display device. Illustratively, each of the light emitting elements 61, 62 and 63 is a light emitting diode (LED). As shown in FIG. 3, the photodetector 42 is illustratively a phototransistor having its collector connected to a source 64 of positive DC voltage, illustratively 15 volts, through a resistor 65. The emitter of the phototransistor 42 is coupled to the base of a transistor 66 whose emitter is connected to ground. Thus, the transistors 42 and 66 are connected in the well known Darlington configuration to provide for increased current gain. The resistor 65 is relatively large, illustratively 120 kilohms, to eliminate dark current effects of the phototransistor 42. As thread is depleted from the bobbin 30, more and more light passes from the source 32 and through the lens 36 and the bores 32 and 33 to impinge upon the base of the phototransistor 42. As the amount of light impinging on the base of the phototransistor 42 increases, increasingly more current flows from the collector to the emitter of the transistor 42. This increasing current to the base of the transistor 66 increases the conductivity of the transistor 66, allowing more current to flow from the collector to the emitter of the transistor 66.

The LED's 61, 62 and 63 are connected in series between the collector of the transistor 66 and the voltage source 64. Additionally, the anodes of each of the LED's 61, 62 and 63 is connected to the voltage source 64 through a respective resistor 71, 72, and 73. Illustratively, each of the resistors 71, 72 and 73 has a resistance value of 560 ohms. Accordingly, as the transistor 66 becomes increasingly more conductive, current will start to flow from the voltage source 64 through the resistor 71, through the LED 61, and through the collector to emitter path of the transistor 66 to ground. This causes the LED 61 to emit increasingly more light. During this time, current is also flowing through the resistor 72 and the LED 62, and also through the resistor 73 and the LED 63, which currents add to the current flowing through the LED 61 from the resistor 71. However, the current levels through the LED's 62 and 63 are insufficient to cause the LED's 62 and 63 to emit visible light until some threshold current level through the LED's is attained. As the bobbin thread becomes more depleted, more light impinges on the base of the phototransistor 42, causing it to become more conductive, which in turn causes the transistor 66 to become more conductive. More current then flows through the LED 61, and the LED 61 becomes increasingly brighter. As the current through the transistor 66 increases, current flow through the resistor 72 and then through the LED 62 will increase, thereby gradually turning on the LED 62. It will be noted that any current flowing through the LED 62 will also flow through the LED 61, so that the LED 62 can never be brighter than the LED 61. As the current through the transistor 66 rises still further, current flow through the resistor 73 and through the LED 63 will increase. This current will also flow through the LED 62 and the LED 61. Thus, as the bobbin thread is depleted, first the LED 61 will turn on, then become increasingly brighter, then the LED 62 will turn on, and become increasingly brighter, and finally the LED 63 will turn on, and become increasingly brighter. Accordingly, the number of LED's that are on, and their relative brightnesses, function as a bar graph display to continuously provide the sewing machine operator with an indication of the amount of thread remaining on the bobbin 30. The aforedescribed arrangement is insensitive to the manner in which the thread is taken off the bobbin 30, and only responds to the overall amount of thread remaining on the bobbin 30.

Accordingly, there has been disclosed an improved bobbin thread level detection and display arrangement for a sewing machine. It is understood that the above-described embodiment is merely illustrative of the application of the principles of this invention. Numerous other embodiments may be devised by those skilled in the art without departing from the spirit and scope of this invention, as defined by the appended claims. For example, although three light emitting devices have been disclosed, this number can be either increased or decreased, depending upon the desired resolution of the arrangement. Further, although a phototransistor and light emitting diodes have been disclosed, other suitable elements may be substituted therefor.

I claim:

1. A sewing machine having a frame including a bed, said bed having a cavity for receiving a loop taker, a loop taker rotatably supported in said cavity, a bobbin case supported in said loop taker against rotation therewith, said bobbin case freely supporting a lower thread carrying bobbin therein, and means for sensing the thread carrying condition of said bobbin, said sensing means including a light source and a light detector, wherein the improvement comprises:

a display device including a plurality of light emitting elements positioned in a regular array; and energizing means responsive to the amount of light impinging on said light detector for controlling the energization of said plurality of light emitting elements to produce a visible light pattern in said display device that is related to the thread carrying condition of said bobbin.

2. The improvement according to claim 1 wherein:

said light detector includes a phototransistor having its collector connected to a first voltage level and its base adapted to receive light from said light source in dependence upon the thread carrying condition of said bobbin; and said energizing means includes a transistor having its base connected to the emitter of said phototransistor and its emitter connected to a second voltage level, said plurality of light emitting elements being connected in series between the collector of said transistor and said first voltage level, said energizing means further including means for connecting the junctions between said serially connected light emitting elements to said first voltage level.

3. The improvement according to claim 2 wherein each of said light emitting elements is a light emitting diode and said means for connecting includes a plurality of resistors each connected to the anode of a respective light emitting diode.

* * * * *